US005365761A

United States Patent [19]

Knauschner et al.

[11] Patent Number: 5,365,761

[45] Date of Patent: Nov. 22, 1994

[54] METHOD FOR THE PRODUCTION OF LOW-RESIDUAL-STRESS ROLLED STRIP

[75] Inventors: Alfred Knauschner; Bernd Richter, both of Freiberg; Gerhard Poppe, Hemer; Lutz Hofmann, Wickede, all of Germany

[73] Assignee: Mannesmann Aktiengesellschaft, Düsseldorf, Germany

[21] Appl. No.: 960,456

[22] PCT Filed: Jun. 5, 1991

[86] PCT No.: PCT/DE91/00484

§ 371 Date: Feb. 5, 1993

§ 102(e) Date: Feb. 5, 1993

[87] PCT Pub. No.: WO91/18688

PCT Pub. Date: Dec. 12, 1991

[30] Foreign Application Priority Data

Jun. 5, 1990 [DE] Germany ..... 3412823

[51] Int. Cl.[5] ..... B21B 37/06

[52] U.S. Cl. ..... 72/12; 72/17

[58] Field of Search ..... 72/12, 17, 8

[56] References Cited

U.S. PATENT DOCUMENTS

| | | | |
|---|---|---|---|
| 3,756,050 | 9/1973 | Kubo et al. | 72/12 |
| 4,537,050 | 8/1985 | Bryant et al. | 72/12 |
| 4,753,093 | 6/1988 | Siemon et al. | 72/17 |
| 5,010,756 | 4/1991 | Nose et al. | 72/12 |

FOREIGN PATENT DOCUMENTS

| | | | |
|---|---|---|---|
| 0108379 | 5/1984 | European Pat. Off. . | |
| 0173045 | 3/1986 | European Pat. Off. . | |
| 85043 | 10/1971 | Germany | 72/12 |
| 0016806 | 1/1988 | Japan | 72/8 |
| 946661 | 1/1964 | United Kingdom | 72/17 |
| 1576216 | 7/1990 | U.S.S.R. . | |

OTHER PUBLICATIONS

Bernsmann, "Lateral Material Flow During Rolling of Strip", Iron & Steel Engineer, Mar. 1972, pp. 67–71.

Becker et al., Wissenshaftliche Zeitschrift der technischen Hochschule Otto Von Guericke Magdeburg, Mar. 1974, pp. 753–761.

Köpstein et al., Neue Hütte, Apr. 1975, pp. 226–228.

Knauschner, Neue Hütte, Mar. 1981, pp. 94–99.

*Primary Examiner*—Lowell A. Larson

*Assistant Examiner*—Thomas C. Schoeffler

*Attorney, Agent, or Firm*—Schweitzer Cornman & Gross

[57] ABSTRACT

The invention relates to the production of low-residual-stress strip and is applicable in the field of metal forming. Pursuant to the invention, the gap between the finishing rolls is adjusted in n strip elements during the rolling process by adjusters in each case by amounts $\Delta S_i$. However, it is not necessary that the number n of measurement zones be equal to the number of adjustment zones. The adjustment amounts $\Delta S_i$ for the individual strip elements are determined continuously, with the inclusion of the no-slip point (FIG. 1) by determining, either before or at the start of the roll pass, the average pass reduction $\overline{\epsilon}_{h,ges}$ as well as the partial reduction $\overline{\epsilon}_{h,k}$, which characterizes the reduction from the no-slip point up to the exit side of the roll gap. The ratio $\overline{\epsilon}_{h,ges}/\overline{\epsilon}_{h,k}$ formed from the two quantities, after multiplicative linkage with the final thickness $h_1$, gives a fixed amount valid for the respective roll pass. After multiplicative linkage of this fixed amount with the actual strip elongation or contraction values $\Delta\epsilon_{l,i}$ obtained by the strip stress measuring equipment for the respective strip element i, the adjustment amounts $\Delta S_i$, required for the fine adjustment of the roll gap contour, are obtained as allowed value for the fine adjustment of the roll gap contour, which takes place by means of adjusters.

2 Claims, 2 Drawing Sheets

METHOD FOR THE PRODUCTION OF LOW-RESIDUAL-STRESS ROLLED STRIP

FIELD OF INVENTION

The invention relates to the production of low-residual stress strip and is applicable to the metal-forming field.

BACKGROUND OF THE INVENTION

Strip is rolled with the objective of avoiding strip waviness and of ensuring that the residual stresses over the width of the rolled strip are low in the longitudinal direction. Recently, different rolling adjusters have been used selectively for this purpose for adjusting the gap between the finishing rolls. Examples of such adjusters include, roller reverse bending equipment, intermediate rollers with symmetrically or asymmetrically shaped roller barrels and movable in the axial direction, movable working rollers, equipment for tilting the rollers, as well as the influencing of the thermal profile of the rollers by the action of defined local cooling agents and profile-changeable supporting rollers. For 20-roller rolling mill, the supporting saddles of the outer supporting rollers additionally are used to adjust the gap between the finishing rolls. (H. Galla, H. Jung: "Walzen yon Flachprodukten" (Rolling Flat Products), published by the Deutsche Gesellschaft fuer Metallkunde, Informationsgesellschaft in 1986).

Additional measuring equipment is used in modern rolling mills for determining the course of the longitudinal stresses over the width of the strip to be able to use these adjusters meaningfully to control the profile of the gap between the finishing rolls with the objective of producing strip with low residual stresses in the longitudinal direction. This measuring equipment determines the course of the strip tension such as by special measuring rollers, feelers and/or through the effect of electromagnetic forces.

From the measured course of the strip tension $\sigma_{li}$, by eliminating the longitudinal tension $\sigma_l$ externally applied during the rolling (for example, by the reel tension), the course of the residual stress $\Delta\sigma_{l,i}$ in the stress-relieved strip $$\Delta\sigma L, i = \sigma L, i - \overline{\sigma} L \quad (1)$$

can be determined from the measured course of the strip stress

+inherent compressive strains

−inherent tensile strains and the longitudinal elongation and contraction contributions can be determined from Hooke's law $$\Delta\epsilon_{L,i} = \frac{\Delta\sigma_{l,i}}{E} \quad (2)$$

+ longitudinal contraction contributions

− longitudinal elongation contributions (see FIG. 1).

The objective pursued is the adjustment of the gap between the finishing rolls by means of the aforementioned adjusters with the help of the signals constantly obtained from the measurement equipment, so that strip waviness is avoided and a strip is produced with a low residual stress in the longitudinal direction.

Special transfer functions are required for the correct conversion of the measured strip tension values $\Delta\sigma_{l,i}$ or the longitudinal extension and contraction values into the adjusting values $\Delta S_i$ required for correcting the gap between the finishing rolls.

In this connection, it was assumed that, in the absence of or in the presence of only slight lateral flow of the strip during the reduction pass, there is a proportionality between the $\Delta\epsilon_{l,i}$ values and the thickness profiles of the deformation values $\Delta\epsilon_{h,i}$ derived from the strip running in and out according to $$\Delta\epsilon L, i = \Delta\epsilon h, i \quad (3)$$

and consequently the thickness adjustment values can be derived from the measured $\Delta\epsilon_{l,i}$ values.

Moreover, FIG. 2 is $$\Delta\epsilon h, i = \epsilon h, i - \overline{\epsilon} \quad (4)$$

wherein $$\epsilon_{h,i} = \frac{h_{0,i} - h_{1,i}}{h_{0,i}} \quad (5)$$

wherein $$\overline{\epsilon} = \frac{\sum_{1}^{n} \epsilon_{h,i}}{n} \quad (6)$$

However, practical rolling experience has shown that the thickness adjusting values $\Delta S_i$, determined for the reduction of the longitudinal stresses from the measured longitudinal extension and stretching values $\Delta\epsilon_{l,i}$ using equation (3), do not lead to the aimed-for objective. Special investigations (Bernsmann, G.P.; Iron and Steel Engineer, 1972/3, pages 67–71; Becker, H. & P. Freundel, Wiss. Zeitschrift der TU Magdeburg 19, 1975, vol. 7/8, pages 753–761; Koepstein, E., G.G. Grigorjan, Ju. D. Zeleznow, Neue Huette 1975, 4, pages 226–228), with inclusion of the strip profile running in and out, revealed very large and highly scattered deviations, $K_M$ which were introduced as the correction factor in the equation $$\Delta\sigma L, i = K_M . E (\epsilon h, i - \overline{\epsilon}) \quad (7)$$

(Equation (7) is related to Equation (3) in the same way as is Equation (2)).

These correction factors include values ranging from $K_M = 0.05 \ldots 0.1 \ldots 0.2$. Likewise, it was observed that the longitudinal stress values $(\Delta\sigma_{l,i})_{gem}$, measured with the strip stress measuring equipment, are much lower than the longitudinal stress changes $(\Delta\sigma_{h,i})_{ber}$ calculated from the thickness profiles. According to Koepstein, this difference is $$\frac{(\Delta\sigma_{L,i})_{gem}}{(\Delta\sigma_{h,i})_{ber}} \simeq 0{,}07 \ldots 0{,}14$$

It was not possible to identify a dependence of these highly fluctuating correction factors on the characterizing rolling conditions. For this reason, the determination of the adjusting values $\Delta S_i$, required for adjusting the gap between the finishing rolls, from the $\Delta\sigma_{l,i}$ and $\Delta\epsilon_{l,i}$ values obtained from the strip stress measuring equipment, is subject to very large uncertainties and inaccuracies, so that the rolling of low-residual-stress strip creates considerable problems. The quality deficiencies of the rolled strip resulting therefrom decrease the use value of the rolled strip and result in economic losses.

DESCRIPTION OF THE INVENTION

It is an object of the invention to use the possibilities for adjusting the gap between the finishing rolls, so that low-residual-stress strip can be produced and with that, prerequisites are created so that a higher strip quality is achieved by rolling and fewer technological difficulties arise when processing the strip and sheet metal.

The invention is based on the technical task of conducting the strip-rolling process for the production of low-residual-stress strip, which is rolled in the usual manner, using adjusters for adjusting the gap between the finishing rolls as well as equipment for measuring the course of the longitudinal stresses over the width of the strip in such a manner, that the adjusting values $\Delta S_i$, corresponding to the actual rolling conditions, can be determined and used for adjusting the gap between the finishing rolls during the manufacture of low-residual-stress strip.

Pursuant to the invention, this objective is accomplished owing to the fact that gap between the finishing rolls is adjusted in n strip elements during the rolling process by adjusters in each case by an amount $\Delta S_i$. For this purpose, however, the number n of the measurement zones does not necessarily have to be equal to the number of adjustment zones. The adjustment amounts $\Delta S_i$ for the individual strip elements, including the no-slip point $h_k$ (FIG. 1), are determined continuously by determining, before or at the start of the roll pass, the average pass reduction $\overline{\epsilon}_{h,ges}$ and the partial reduction amount $\overline{\epsilon}_{h,k}$, which characterizes the reduction from the no-slip point to the exit side of the roll gap. After multiplicative linkage with the final thickness $h_1$, the ratio $\overline{\epsilon}_{h,ges}/\overline{\epsilon}_{h,k}$ formed from the two quantities gives a fixed amount valid for the particular roll pass $$\frac{\overline{\epsilon}_{h,ges}}{\overline{\epsilon}_{h,k}} \cdot h_1$$

After multiplicative linkage of this fixed amount with the actual strip elongation or contraction values $\Delta\epsilon_{l,i}$ obtained by the strip measuring equipment for the respective strip element i, the adjustment amounts $\Delta S_i$ is obtained as allowed value for the fine adjustment of the roll gap contour, which is accomplished by means of the adjuster.

In those case in which the strip stress measuring equipment shows the measured values for the respective strip element i not as actual strip elongation or contraction values $\Delta\epsilon_{l,i}$, but as strip longitudinal stresses $\Delta\sigma_{l,i}$ these stress values are converted by Hooke's law into strip elongation or contraction values.

DETAILED DESCRIPTION OF THE INVENTION

Figure 1:
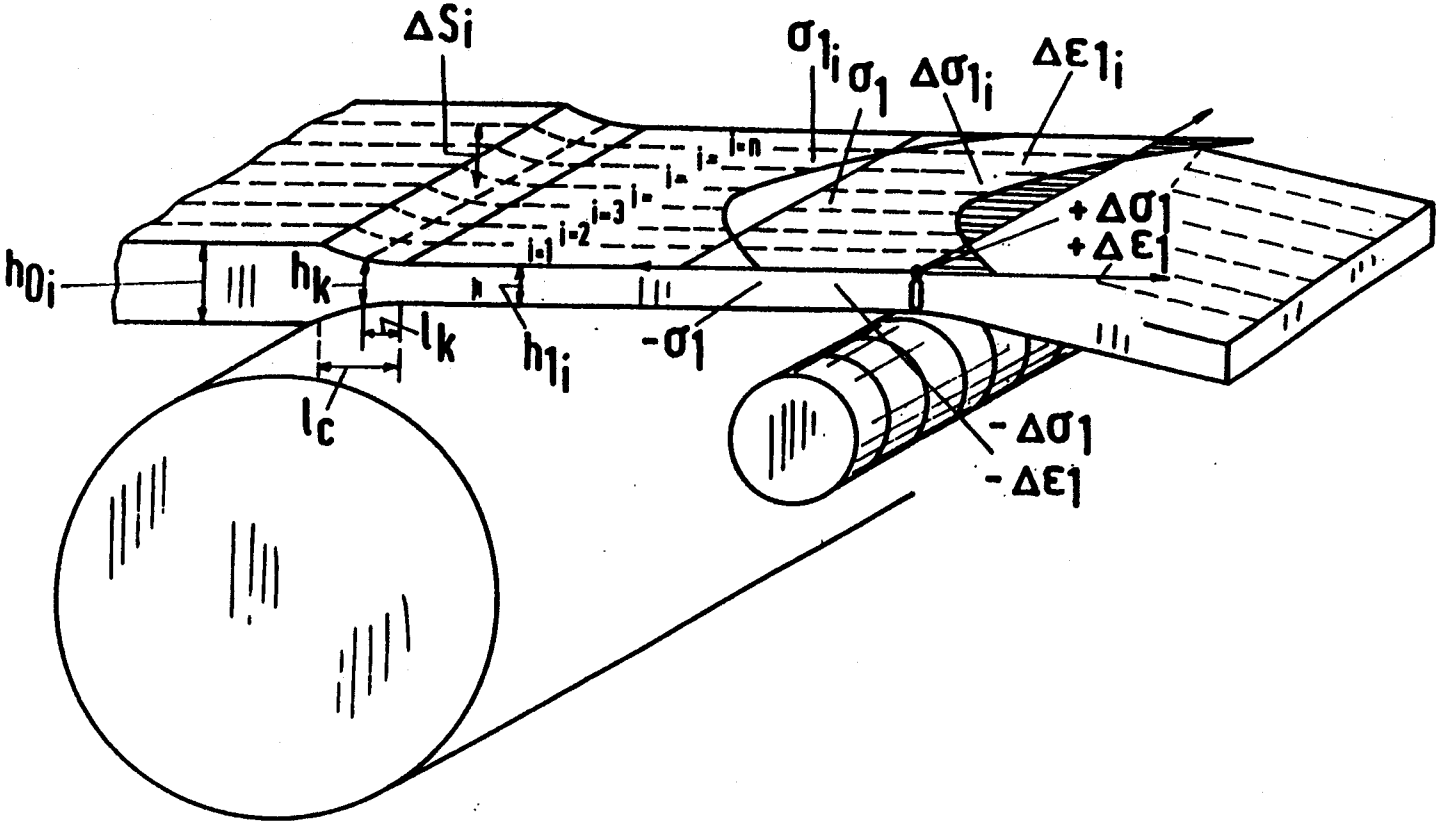
Figure 2:
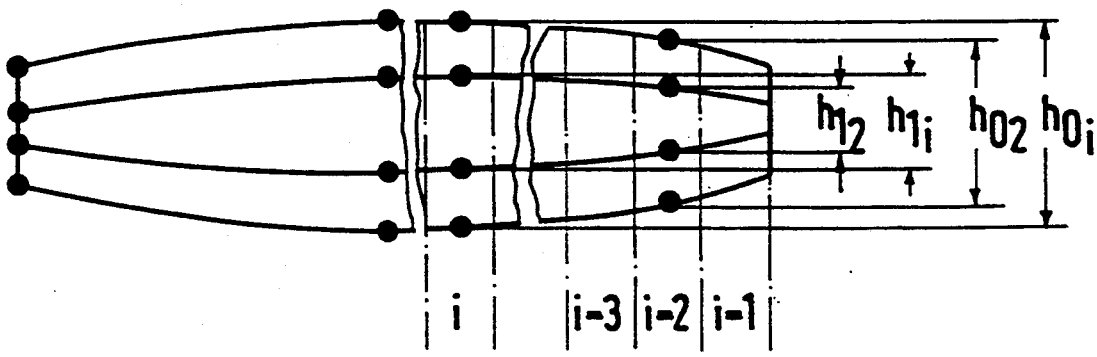

The invention is described in greater detail in the detailed description of a suitable embodiment and employing the following values (see also FIG. 2):

$h_{o,i}$ local thickness before the pass in the ith strip element, $h_{l,i}$ local thickness after the pass in the ith strip element, $h_o$ average strip thickness before the pass, $h_1$ average strip thickness after the pass, $h_k$ average thickness at the no-slip point (FIG. 1), $l_k$ distance between the no-slip point and the exit side of the roll gap $l_d$ printed length of the roll gap R radius of the working roller A metal strip of deep-drawing steel, with a width of 300 mm, is rolled from an average starting thickness of $h_o$=0.47 mm into an average final thickness $H_1$=0.34 mm in a 20-roller rolling mill with a working roller radius R =21 min. The outer longitudinal stress, applied here by the tension roll, is $\sigma_l = -180$ N/mm$^2$. The longitudinal stress $\sigma_{l,i}$, which is given in Table 1, column 2, and measured in n=11 strip elements distributed uniformly over the width of the strip, is recorded by strip stress measuring equipment. The course of the longitudinal stress $\Delta\sigma_{l,i}$, determined for an instantaneous state by equation (1), is shown in column 3 of Table 1. From this are obtained the longitudinal elongation and contraction amounts $\Delta\epsilon_{l,i}$ using equation (2); they are given in column 4 of Table 1.

Pursuant to the invention, the following are determined before or at the start of the roll pass:

$$\overline{\epsilon}_{h,ges} = \frac{h_0 - h_1}{h_0} \tag{8}$$

with $$\overline{\epsilon}_{h,ges}=0{,}2766$$

the height of the no-slip point $h_k$ according to known equations (for example, A. Knauschner, Freiberger Forschungshefte B 267, VEB Dr. Verlag für Grundstoffindustrie, Leipzig 1989 or Neue Hütte 1981, 3. pages 94 to 99).

$$h_k = h_1 + 2R\{1\text{-}\cos[\arcsin(l_k/l_d - l_d/l_d/R)]\} \tag{9}$$

In the present example, for a specific distance of the no-slip point $l_k/l_d$=0.3, the no-slip point is calculated from Equation (9) to be $h_k$=0.3517.

the partial reduction amount $$\overline{\epsilon}_{h,k} = \frac{h_k - h_1}{h_0} \tag{10}$$

which characterizes the average reduction from the no-slip point to the exit side of the roll gap, and amounts to $\overline{\epsilon}_{h,k}$=0.0249 in this example.

the fixed amount applying for this reduction pass $$\frac{\overline{\epsilon}_{h,ges}}{\overline{\epsilon}_{h,k}} \cdot h_1$$

assumes the value of 3.7773 in the example.

During the reduction pass, the respective adjustment amounts $\Delta S_i$ are determined as the allowed values for the fine adjustment of the roll gap contour, in that the fixed amount of 3.7773, valid for this reduction pass, continuously is linked multiplicatively with the actual elongation and contraction amounts Act, determined by the strip tension measuring equipment.

The adjustment amounts $\Delta S_i$ in column 5 of Table 1 are determined in this manner.

If the $\Delta S_i$ values are negative, the height $h_{l,i}$ of the gap between the finishing rolls is reduced in the associated strip elements by the given values $\Delta S_i$ by means of suitable adjusters. Positive $\Delta S_i$ values, on the other hand, require an enlargement of the height $h_{1,i}$ of the roll gap by the given $\Delta S_i$ value. After this correction of the gap between the finishing rolls, the strip has a low residual stress. If the values $\Delta\epsilon_{l,i}$ measured at the strip stress equipment change, the $\Delta S_i$ values measured must be measured once again in the manner given.

TABLE 1

| 1 Strip Element 1 | 2 Magnitude of Strip Tension $\sigma_{l,i}$ in N/mm$^2$ | 3 Residual Stress $\Delta\sigma_{l,i}$ N/mm$^2$ | 4 Elongation or Contraction $\Delta\epsilon_{l,i} \times 10^5$ | 5 Adjustment Amount $\Delta s_i$ mm $\times 10^5$ |
|---|---|---|---|---|
| 1 | −180 | 0 | 0 | 0 |
| 2 | −186 | −6 | −2.86 | −10.79 |
| 3 | −198 | −18 | −8.57 | −32.38 |
| 4 | −180 | 0 | 0 | 0 |
| 5 | −167 | +13 | +6.19 | +23.38 |
| 6 | −155 | +25 | +11.90 | +44.97 |
| 7 | −149 | +31 | +14.76 | +55.76 |
| 8 | −180 | 0 | 0 | 0 |
| 9 | −192 | −12 | −5.71 | −21.58 |
| 10 | −198 | −18 | −8.57 | −32.38 |
| 11 | −180 | 0 | 0 | 0 |

We claim:

1. In the process for continuously rolling a strip having a forward speed between the rollers that have a peripheral speed, wherein the strip has a thickness, the rolling taking place in a reduction pass between rollers for reducing the thickness of the strip, wherein the point at which the rolls first contact the strip is the starting point of the rolling, and wherein the forward speed of the rolled strip between the rolls is identical to the surface speed of the rolls at a no-slip point, and wherein the thickness of the strip exiting from between the rolls is the final thickness of the strip which undergoes elongation or contraction during the rolling, the rolling including the use of finishing rolls with a gap therebetween, an adjuster for adjusting the gap, and apparatus for continuously measuring in "n" number of measuring zones longitudinal stress over the width of the strip, the improvement which comprises (a) continuously adjusting with the adjuster the gap between the finishing rolls in n strip elements and a number of adjustment zones by an increment of $S_i$ for a respective strip element i, wherein said increment is calculated by continuously measuring the no-slip point from the average thickness reduction pass $\epsilon_{h,ges}$, and the amount $\epsilon_{h,k}$ of partial thickness reduction from the no-slip point to the exit side of the gap, the determination of the average reduction pass being made before or at the starting point of the pass, (b) determining the ratio of $\epsilon_{h,ges}/\epsilon_{h,k}$ that is a constant for a given pass of the rolls, and (c) forming the product of said ratio with $h_1$ which is the final thickness of the strip and with $\epsilon_{l,i}$ that is the value of the elongation or contraction measured on the strip element i.

2. The process of claim 1, further comprising converting said value of the elongation or contraction measured on the strip element i by Hooke's law into a calculated elongation or contraction value.

* * * * *